US008648890B2

(12) United States Patent
Eoka

(10) Patent No.: US 8,648,890 B2
(45) Date of Patent: Feb. 11, 2014

(54) HEAD PRESSURIZING FORCE ADJUSTING DEVICE, IMAGE FORMING APPARATUS AND METHOD OF ADJUSTING HEAD PRESSURIZING FORCE

(75) Inventor: Kenji Eoka, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 26 days.

(21) Appl. No.: 13/405,494

(22) Filed: Feb. 27, 2012

(65) Prior Publication Data

US 2012/0218368 A1 Aug. 30, 2012

(30) Foreign Application Priority Data

Feb. 28, 2011 (JP) ..... 2011-42084

(51) Int. Cl.
*B41J 25/304* (2006.01)

(52) U.S. Cl.
USPC ..... 347/198

(58) Field of Classification Search
USPC ..... 347/197, 198; 400/120.16
See application file for complete search history.

(56) References Cited

U.S. PATENT DOCUMENTS 6,788,326 B2 * 9/2004 Sasaki ..... 347/198

FOREIGN PATENT DOCUMENTS

| | | |
|---|---|---|
| JP | 62-080064 | 4/1986 |
| JP | 05-014641 | 1/1993 |
| JP | 6-255190 | 9/1994 |
| JP | 08-090870 | 4/1996 |
| JP | 08-300697 | 11/1996 |
| JP | 10-076713 | 3/1998 |
| JP | 3068602 | 5/2000 |
| JP | 2000-168113 | 6/2000 |
| JP | 2000-272151 | 10/2000 |
| JP | 2002-154258 | 5/2002 |
| JP | 2008-006681 | 1/2008 |
| JP | 2010-228324 | 10/2010 |
| JP | 2010-272151 | 12/2010 |

OTHER PUBLICATIONS

Notification of Reasons for Refusal for Patent Application No. 2011-042084 Dated Mar. 19, 2013, 14 pgs.

* cited by examiner

*Primary Examiner* — Huan Tran
(74) *Attorney, Agent, or Firm* — Turocy & Watson, LLP

(57) ABSTRACT

According to one embodiment, an image forming apparatus includes a first sensor, a second sensor, a first head, a first head pressurizing force adjusting device, a second head, a second head pressurizing force adjusting device, and a control unit. The first and second sensors detect a recording medium. The first head forms an image on a first surface of the recording medium and the second head forms an image on a second surface of the recording medium. The first head pressurizing force adjusting device adjusts a pressurizing force of the first head to the first platen and the second head pressurizing force adjusting device adjusts a pressurizing force of the second head to the second platen. The control unit controls the first head pressurizing force adjusting device and the second head pressurizing force adjusting device based on outputs of the first and second sensors.

15 Claims, 11 Drawing Sheets

HEAD PRESSURIZING FORCE ADJUSTING DEVICE, IMAGE FORMING APPARATUS AND METHOD OF ADJUSTING HEAD PRESSURIZING FORCE

CROSS-REFERENCE TO RELATED APPLICATIONS

This application is based upon and claims the benefit of priority from Japanese Patent Application No. 2011-042084 filed on Feb. 28, 2011, the entire content of which are incorporated herein by reference.

FIELD

Embodiments described herein relate to a head pressurizing force adjusting device, an image forming apparatus and a method of adjusting a head pressurizing force.

BACKGROUND

There are some types of image forming apparatuses for continuously printing both sides of a recording medium, including opposing printing heads with a recording medium conveyance path interposed therebetween.

Such types of image forming apparatuses generally include thermal heads disposed in the vicinity of upstream and downstream in a recording medium conveyance direction. The thermal heads are disposed opposite to a platen with the recording medium conveyance path interposed therebetween. The recording medium is conveyed by rotation of the platen. The conveyance of the recording medium requires rotating the platen with the thermal heads pressurized to the platen.

However, when the recording medium is discharged, if the thermal head in the upstream in the recording medium conveyance direction continues to be pressurized to the platen even when a tailing end of the recording medium escapes from the thermal head, then the thermal head may be worn out by contact with the platen.

Further, to print a leading end of the recording medium, there is a need to move the recording medium forward or backward to adjust a printing position. In such a case, if the thermal head in the downstream in the recording medium conveyance direction continues to be pressurized to the platen until the recording medium arrives at the thermal head, then the thermal head may be worn out by contact with the platen.

Moreover, when the recording medium is removed from the image forming apparatus, it becomes difficult to draw the recording medium out if the thermal heads continue to be pressurized to the platen.

In this regard, there has been proposed a technique that can adjust a pressurizing force of a head using a cam.

However, two sets of thermal heads and platens require a more complicated control.

Accordingly, there is a need of head pressurizing force adjusting device, an image forming apparatus and a head pressurizing force adjusting method, which can change a pressurizing force of thermal heads depending on conditions of the image forming apparatus.

DETAILED DESCRIPTION

According to one embodiment, an image forming apparatus includes a first sensor disposed in the downstream of a recording medium conveyance path and detects a recording medium, a second sensor disposed in the upstream of the recording medium conveyance path and detects the recording medium, a first head interposed between the first sensor and the second sensor in the opposite to a first platen with the recording medium conveyance path interposed between the first head and the first platen and forms an image on a first surface of the recording medium, a first head pressurizing force adjusting device that adjusts a pressurizing force of the first head to the first platen, a second head interposed between the first head and the second sensor in the opposite to a second platen with the recording medium conveyance path interposed between the second head and the second platen and forms an image on a second surface of the recording medium, a second head pressurizing force adjusting device that adjusts a pressurizing force of the second head to the second platen, and a control unit that controls the first head pressurizing force adjusting device and the second head pressurizing force adjusting device based on outputs of the first and second sensors.

Embodiments of a head pressurizing force adjusting device, an image forming apparatus and a head pressurizing force adjusting method will now be described in detail with reference to the drawings.

Figure 1:
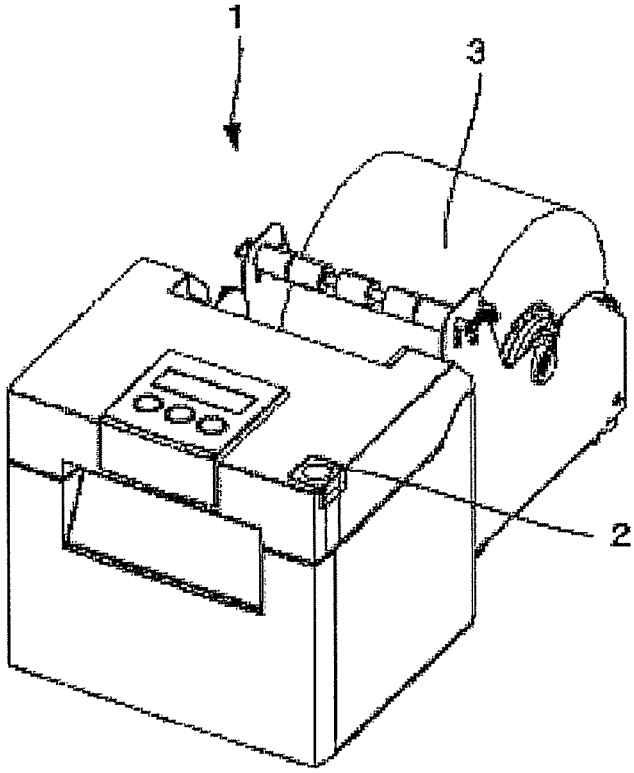
FIG. 1 is a perspective view of an image forming apparatus.

FIG. 1 is a perspective view of an image forming apparatus 1 including a head pressurizing force adjusting device according to an embodiment. As shown in FIG. 1, the image forming apparatus 1 includes an open key 2. When the open key 2 is pressed, the image forming apparatus 1 discharges a recording medium 3 from the apparatus.

Figure 2:
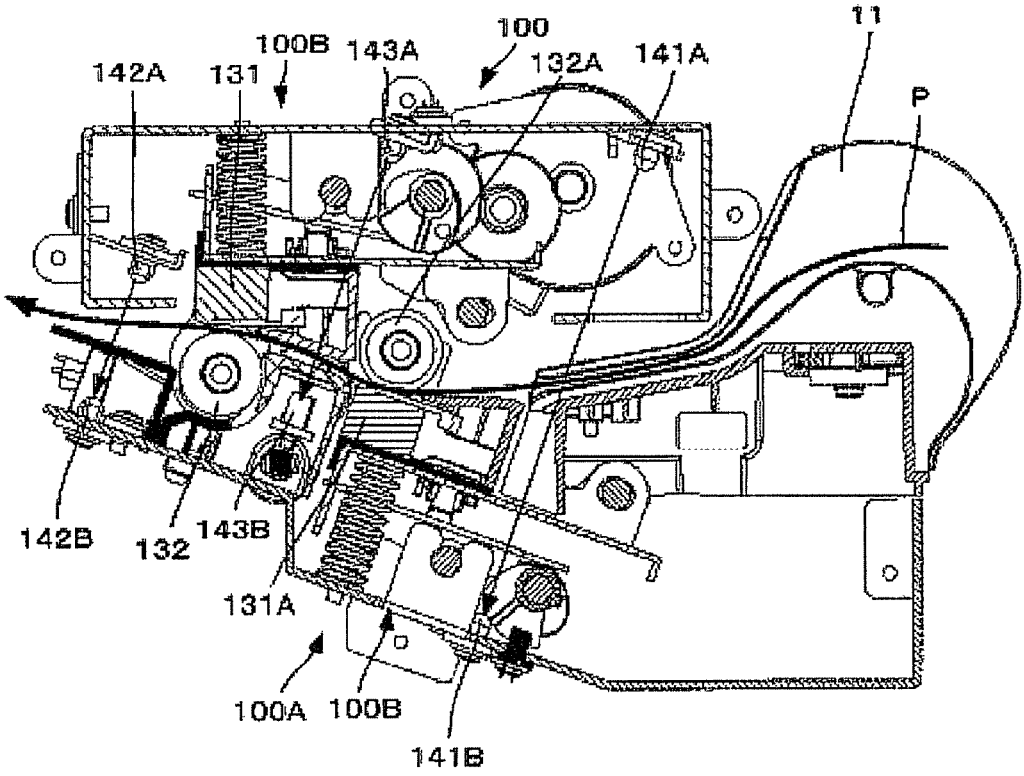
FIG. 2 is a side view of the image forming apparatus.

FIG. 2 is a side view of the image forming apparatus 1. As shown in FIG. 2, the image forming apparatus 1 includes a recording medium conveyance guide 11 and first and second printing devices 100 and 100A, which are opposed to each other with a recording medium conveyance path P interposed therebetween.

In the image forming apparatus 1, the first printing device 100 is disposed in the downstream in a recording medium conveyance direction and the second printing device 100A is disposed in the upstream in the recording medium conveyance direction. The first printing device 100 forms an image on a front surface of the recording medium 3 and the second printing device 100A forms an image on a back surface of the recording medium 3.

The image forming apparatus 1 further includes: a light emitting device 141A and a paper end sensor 141B for detecting the recording medium 3 in the upstream in the recording medium conveyance direction of the second printing device 100A; a light emitting device 143A and a transmission/reflection type sensor 143B between the first and second printing devices 100 and 100A; and a light emitting device 142A and a discharge sensor 142B for detecting the recording medium 3 in the downstream in the recording medium conveyance direction of the second printing device 100A.

In the following description, the paper end sensor 141B as a second sensor is referred to as a PE sensor 141B, the transmission/reflection type sensor 143B as a third sensor is referred to as an BD/LG sensor 143B, and the discharge sensor 142B as a first sensor is referred to as an EXIT sensor 142B.

The BD/LG sensor 143B includes an LG sensor that detects a label attached to the recording medium 3 by detecting an intensity of transmission light of the recording medium 3, and a reflection type BD sensor that detects a black mark representing a printing start position on the recording medium 3.

The PE sensor 141B and the EXIT sensor 142B is turned ON when the recording medium 3 is detected while being turned OFF when no recording medium is detected.

The LG sensor is turned ON when the label is detected while being turned OFF when no label is detected. The BD sensor is turned ON when the black mark is detected while being turned OFF when no black mark is detected.

The first printing device 100 has the same configuration as the second printing device 100A. As such, only the first printing device 100 will be described for the purpose of brevity.

The first printing device 100 includes a head 131 such as a thermal head for forming an image, and a platen 132 opposed to the head 131 with the recording medium conveyance path P interposed therebetween. Further, the first printing device 100 includes a head pressurizing force adjusting mechanism 100B, which adjusts a pressurizing force of the head 131 to the platen 132.

Figure 3:
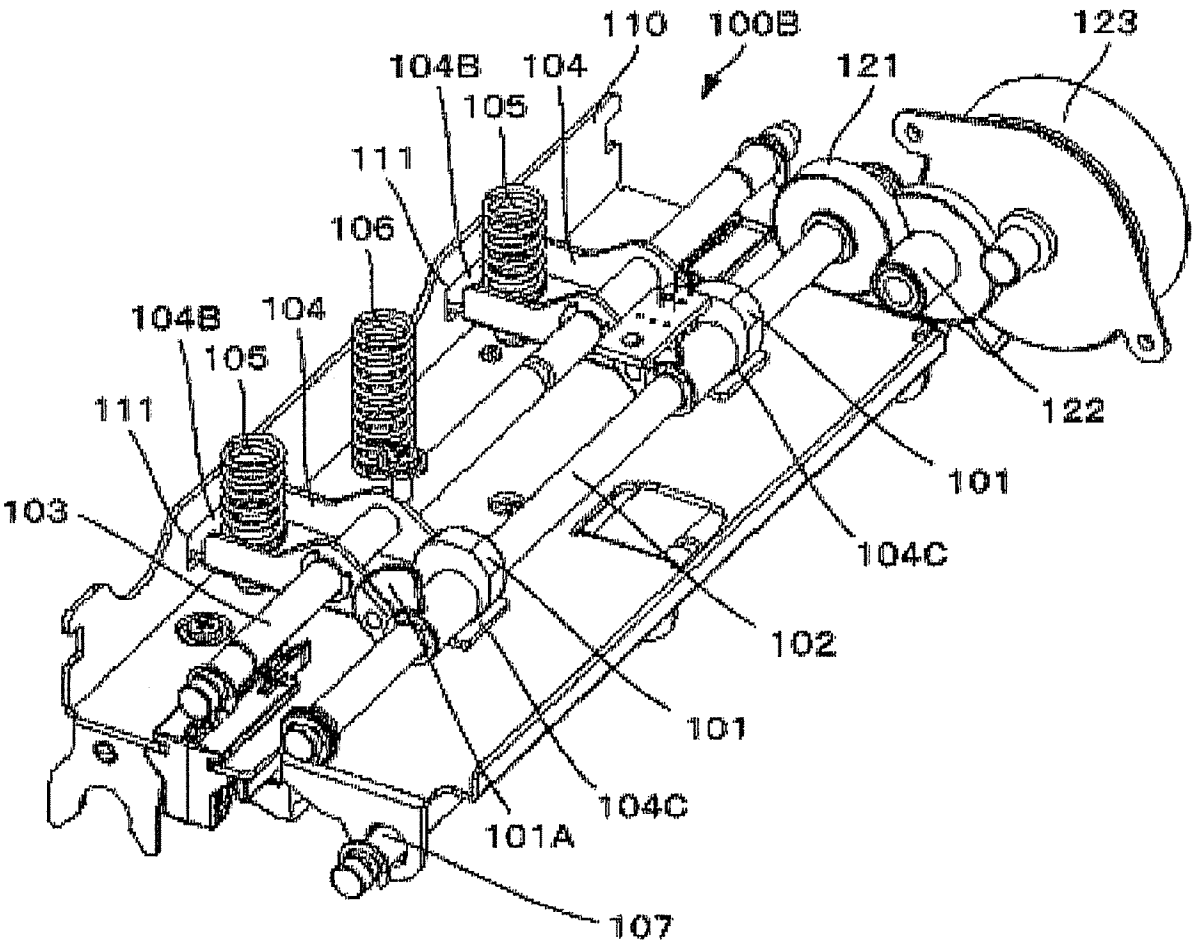
FIG. 3 is a perspective view of a head pressurizing force adjusting mechanism.

FIG. 3 is a perspective view of the head pressurizing force adjusting mechanism 100B. As shown in FIG. 3, the head pressurizing force adjusting mechanism 100B includes: a cam shaft 102 including a pair of first cams 101 and a light shield plate 101A for detection of a home position; a pair of head upper/lower arms 104 pressed by the first cams 101 to be rotated around an arm shaft 103; a pair of first elastic springs 105 that biases the head upper/lower arms 104 toward the platen 132; a head support member 110 rotated around a stay shaft 107 and presses the head 131 toward the platen 132; a second elastic spring 106 that biases the head support member 110 toward the platen 132; a cam gear 121 that rotates the cam shaft 102; a reduction gear 122; and a first cam motor 123.

In the following description, a cam of the second printing device is referred to as a second cam and a cam motor thereof is referred to as a second cam motor.

The head upper/lower arms 104 bias the head support member 110 toward the platen 132 by the first springs 105.

The head support member 110 has an L-like section. The head support member 110 includes an opening 111 in its bent portion. A leading end 104B of the head upper/lower arms 104 is inserted in the opening 111. A tailing end 104C of the head upper/lower arms 104 makes contact with the first cams 101.

Figure 4:
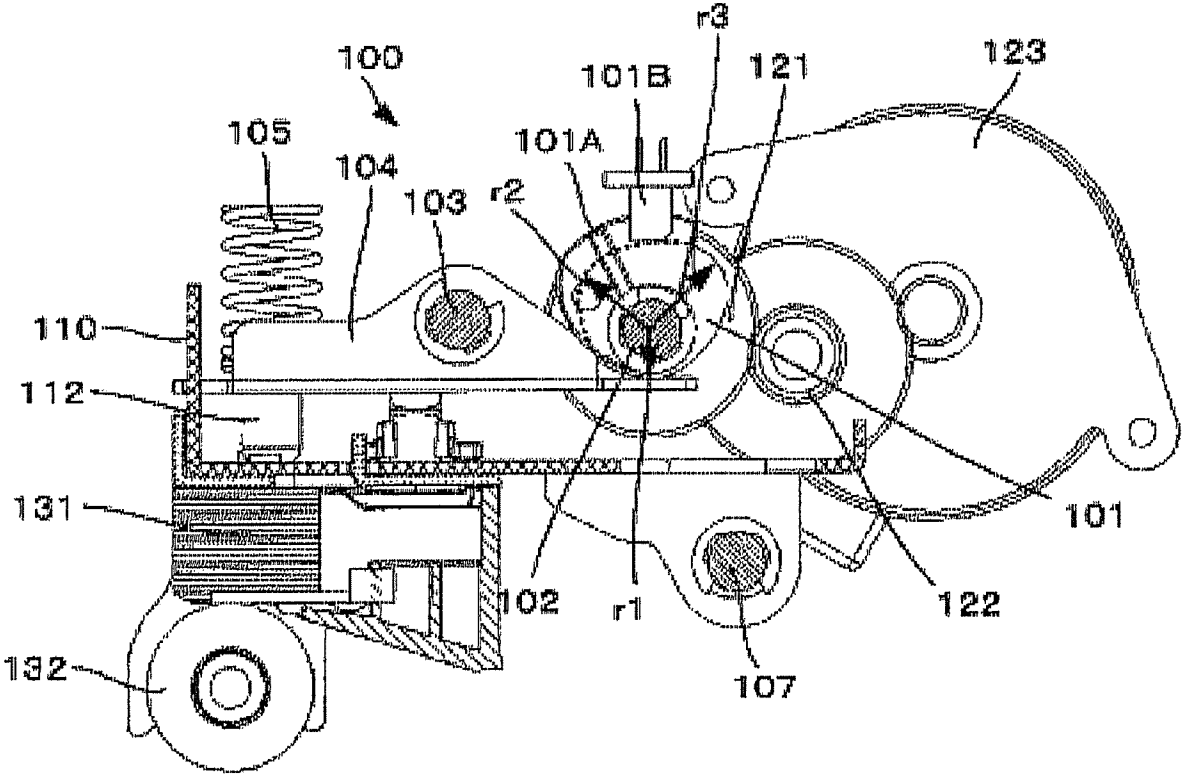
FIG. 4 is a side sectional view of the head pressurizing force adjusting mechanism.

FIG. 4 is a side sectional view of the head pressurizing force adjusting mechanism 100B. As shown in FIG. 4, the head pressurizing force adjusting mechanism 100B includes a home position sensor 101B for detecting a home position of the first cams 101.

The first cams 101 of the head pressurizing force adjusting mechanism 100B have 3 different radiuses.

In the following description, the shortest radius of the first cams 101 is referred to as r1, a position of the first cams 101 at which a position of r1 makes contact with the head upper/lower arms 104 is referred to as a position I (not shown), the longest radius of the first cams 101 is referred to as r3, a position of the first cams 101 at which a position of r3 makes contact with the head upper/lower arms 104 is referred to as a position III (not shown), an intermediate radius between r1 and r3 of the first cams 101 is referred to as r2, and a position of the first cams 101 at which a position of r2 makes contact with the head upper/lower arms 104 is referred to as a position II (not shown).

In the image forming apparatus 1, when the light shield plate 101A for detection of the home position turns ON the home position sensor 101B, the first cams 101 are detected to be in position I, and the first cams 101 are rotated to position II and position III by counting the step number of the first cam motor 123 which may be a stepping motor.

FIG. 4 shows a state of the head pressurizing force adjusting mechanism 100B in position I. In position I, the second spring 106 presses the head support member 110 toward the platen 132 directly and the first springs 105 press the head support member 110 toward the platen 132 via the head upper/lower arms 104 and a contact member 112.

Accordingly, in position I, the head 131 is strongly pressed to the platen 132 by means of the three springs.

Figure 5:
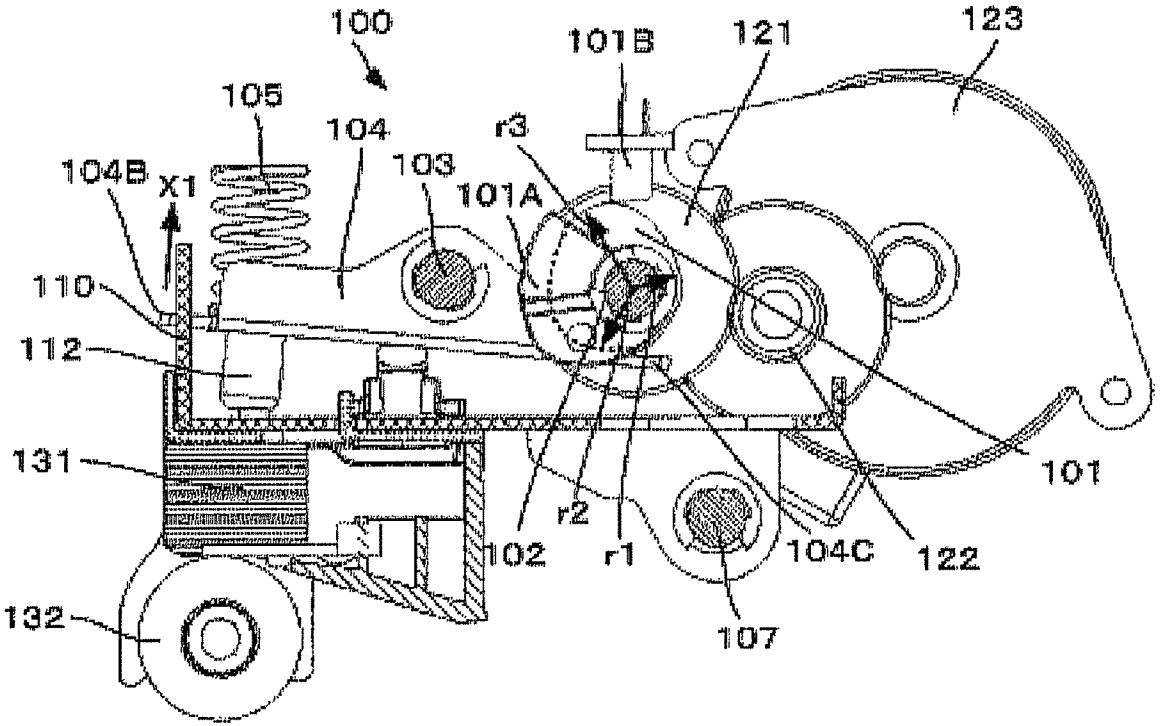
FIG. 5 is a side sectional view of the head pressurizing force adjusting mechanism in position II.

FIG. 5 is a side sectional view of the head pressurizing force adjusting mechanism 100B in position II. As shown in FIG. 5, the first cams 101 push the tailing end 104C of the head upper/lower arms 104 down. When the tailing end 104C is pushed down, the head upper/lower arms 104 are rotated around the arm shaft 103 such that the leading end 104B is displaced in a direction X1 to be separated from the platen 132.

When the leading end 104B is displaced in the direction X1, an elastic force of the first springs 105 is not allowed to be delivered to the head support member 110.

Accordingly, in position H, the head 131 is weakly pressed to the platen 132 only by means of the second spring 106.

Figure 6:
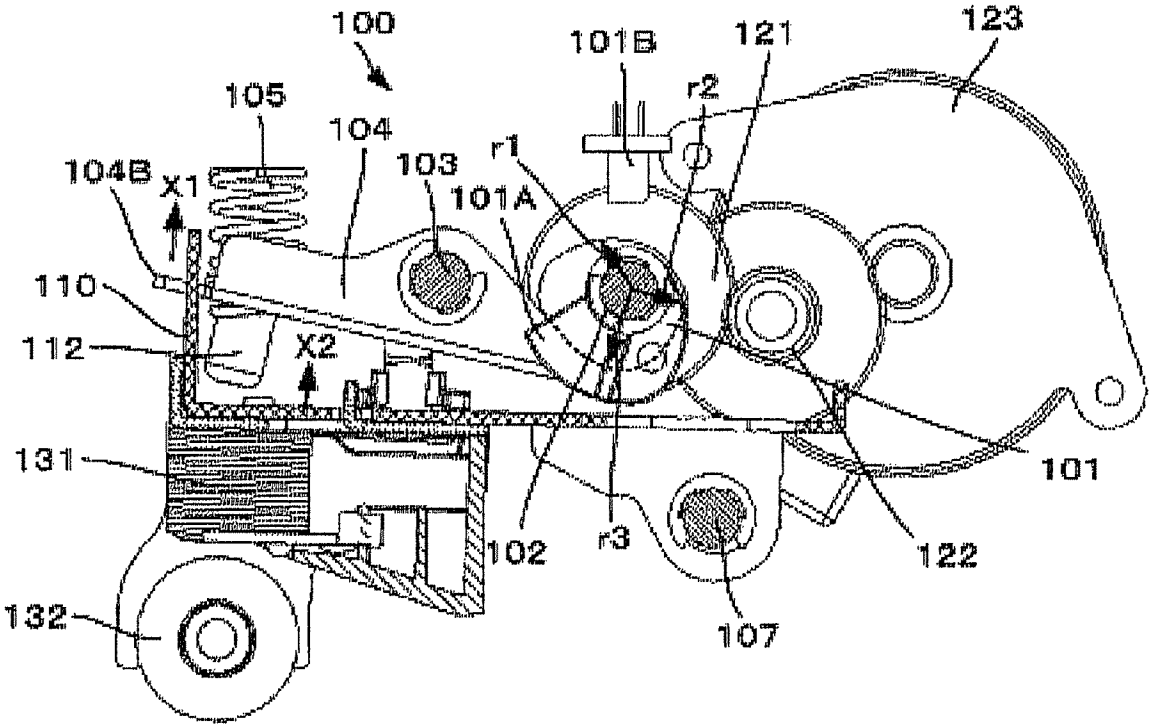
FIG. 6 is a side sectional view of the head pressurizing force adjusting mechanism in position III.

FIG. 6 is a side sectional view of the head pressurizing force adjusting mechanism 100B in position III. As shown in FIG. 6, the first cams 101 further push the tailing end 104C of the head upper/lower arms 104 down. When the tailing end 104C is further pushed down, the head upper/lower arms 104 are further rotated around the arm shaft 103 such that the leading end 104B is further displaced in the direction X1 in contact with the top of the opening 111.

When the leading end 104B pushes the top of the opening 111 up, the head support member 110 is rotated around the stay shaft 107 in a direction X2.

When the head support member 110 is displaced in the direction X2, an elastic force of the second spring 106 is not allowed to be delivered to the head support member 110.

Accordingly, the head 131 is separated from the platen 132 in position III.

Figure 7:
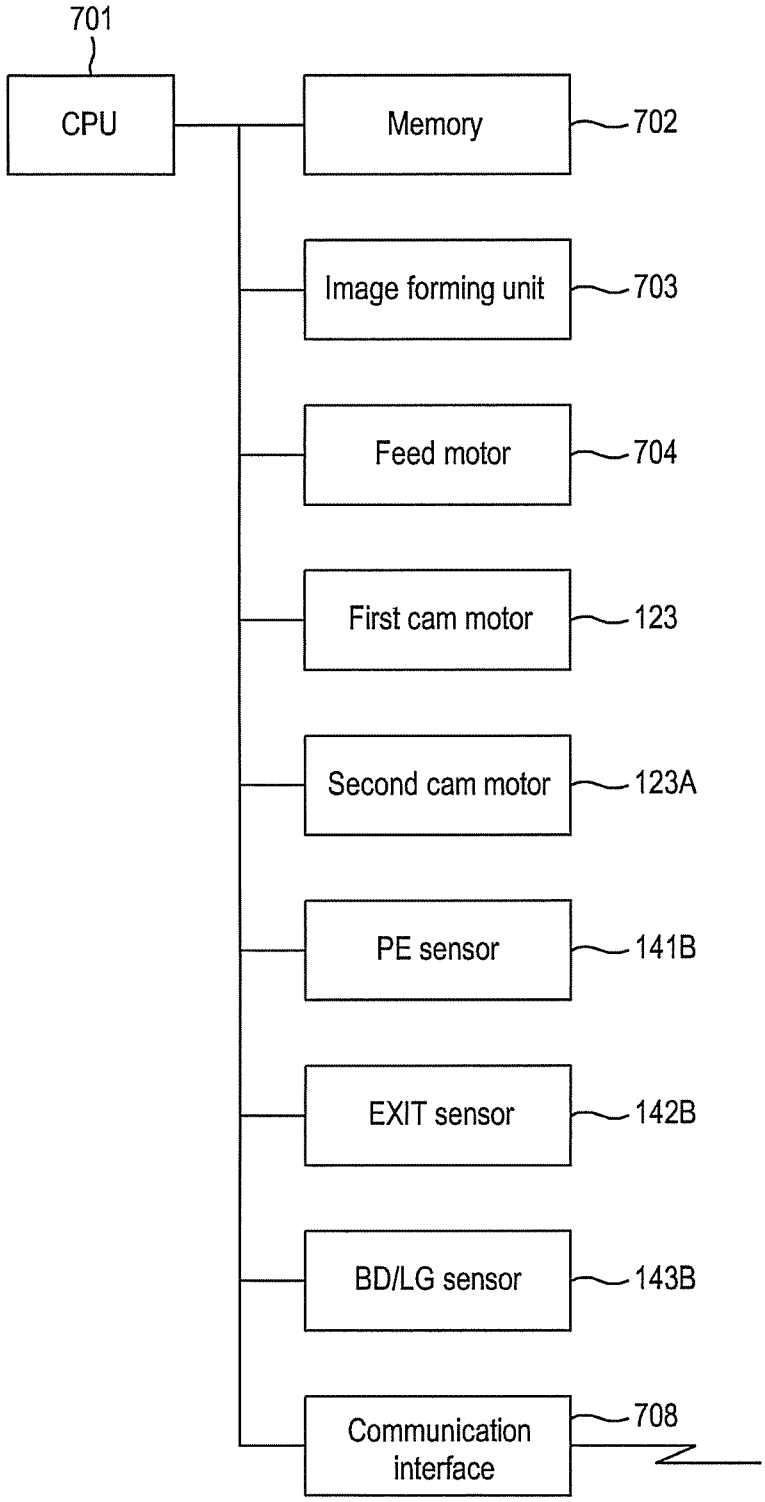
FIG. 7 is a block diagram showing a configuration of the image forming apparatus.

FIG. 7 is a block diagram showing a configuration of the image forming apparatus 1. As shown in FIG. 7, the image forming apparatus 1 includes a CPU 701 as a control unit, a memory 702 as a storage device, an image forming unit 703 for forming an image, a feed motor 704 for driving the platen 132, the first cam motor 123, a second cam motor 123A, the PE sensor 141B, the BD/LG sensor 143B, the EXIT sensor 142B, and an interface 708 for communication with a higher rank device such as a host computer.

The CPU 701 receives outputs from the PE sensor 141B, the BD/LG sensor 143B and the EXIT sensor 142B.

The CPU 701 controls operation of the feed motor 704, the first cam motor 123 and the second cam motor 123A based on a combination of input values from the PE sensor 141B, the BD/LG sensor 143B and the EXIT sensor 142B.

Figure 8:
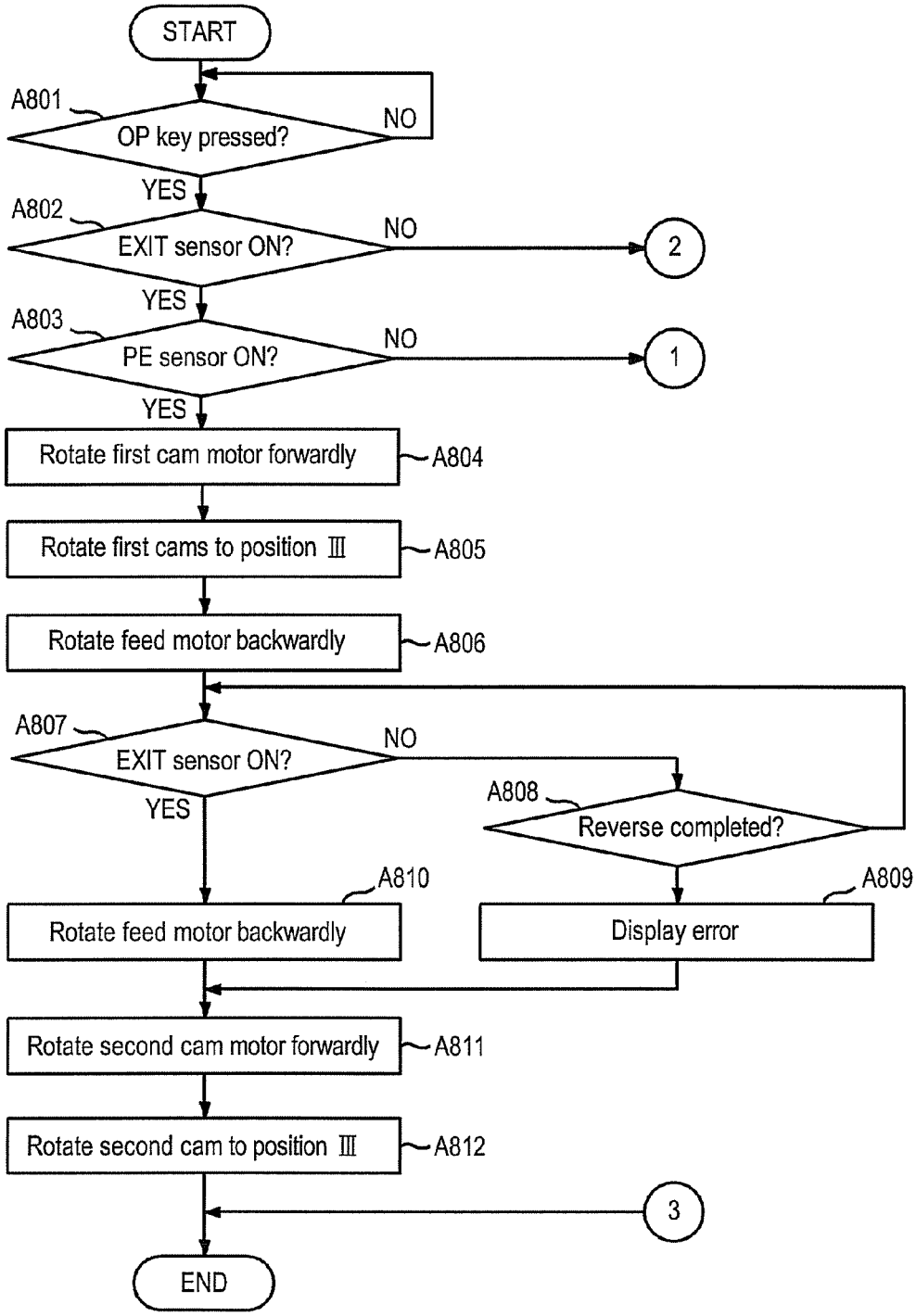
FIG. 8 is a flow chart showing a recording medium discharging operation of the image forming apparatus.
Figure 9:
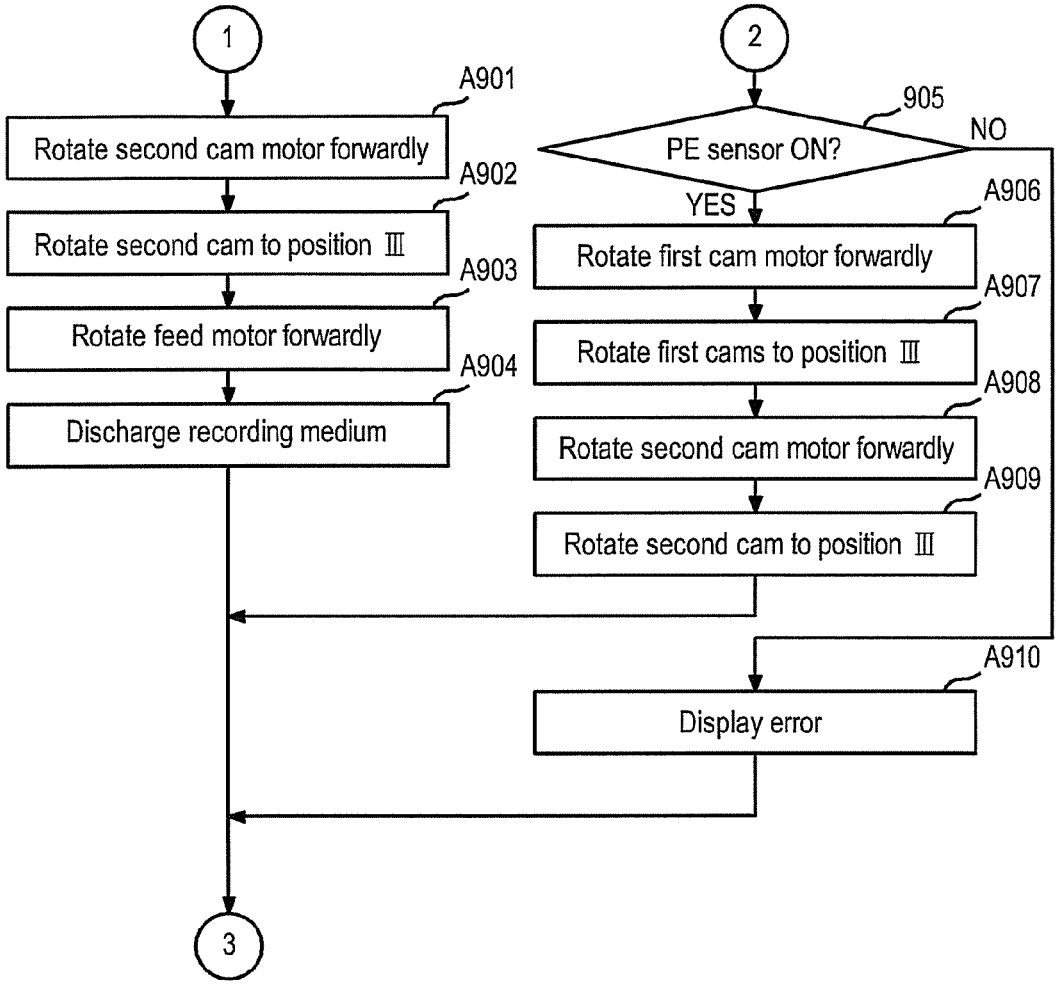
FIG. 9 is a continuation of the flow chart showing the recording medium discharging operation of the image forming apparatus.

FIG. 8 is a flow chart showing a recording medium discharging operation of the image forming apparatus 1. FIG. 9 is a continuation of the flow chart showing the recording medium discharging operation of the image forming apparatus 1. As shown in FIG. 8, in Act A801, the image forming apparatus 1 determines whether or not the open key (OP key) 2 is pressed. If the OP key 2 is pressed, then the image forming apparatus 1 proceeds to Act A802. Otherwise, the image forming apparatus 1 returns to Act A801.

In Act A802, the image forming apparatus 1 determines whether or not the EXIT sensor 142B is turned ON. If the EXIT sensor 142B is turned ON, then the image forming apparatus 1 proceeds to Act A803. Otherwise, the image forming apparatus 1 proceeds to Act A905 of FIG. 9.

In Act A803, the image forming apparatus 1 determines whether or not the PE sensor 141B is turned ON. If the PE sensor 141B is turned ON, then the image forming apparatus 1 proceeds to Act A804. Otherwise, the image forming apparatus 1 proceeds to Act A901 of FIG. 9.

If the PE sensor 141B and the EXIT sensor 142B are both turned OFF, that is, if the recording medium 3 exists over the entire range of the recording medium conveyance path, the image forming apparatus 1 discharges the recording medium 3 by reversing it, that is, by moving it backward.

At this time, the head 131 of the first printing device 100 is first separated from the platen 132, and then, when the recording medium 3 is escaped from the EXIT sensor 142B, the head 131A of the second printing device 100A is separated from the platen 132A, which will be described in more detail below.

In Act A804, the image forming apparatus 1 rotates the first cam motor 123.

In Act A805, the image forming apparatus 1 rotates the first cams 101 to position III.

In Act A806, the image forming apparatus 1 rotates the feed motor 704 reversely to move the recording medium 3 backward.

In Act A807, the image forming apparatus 1 determines whether or not the EXIT sensor 142B is turned OFF. If the EXIT sensor 142B is turned OFF, then image forming apparatus 1 proceeds to Act A810. Otherwise, the image forming apparatus 1 proceeds to Act A808.

In Act A810, the image forming apparatus 1 rotates the feed motor 704 by the predetermined number of steps sufficient to discharge the recording medium.

In Act A808, the image forming apparatus 1 determines whether or not the reverse of the recording medium by a predetermined length has been completed. If the reverse of the recording medium by a predetermined length has been completed, then the image forming apparatus 1 displays an error in Act A809 and then proceeds to Act A811. Otherwise, the image forming apparatus 1 returns to Act A807.

In Act A811, the image forming apparatus 1 rotates the second cam motor 123A.

In Act A812, the image forming apparatus 1 rotates the second cam 101A to position III.

If the PE sensor 141B is turned OFF and the EXIT sensor 142B is turned ON, that is, if the recording medium 3 exists only near the first printing device 100 on the recording medium conveyance path, then the image forming apparatus 1 discharges the recording medium 3 by forwarding it, that is, by moving it forward.

At this time, the head 131A of the second printing device 100A is separated from the platen 132A, which will be described in more detail below.

In Act A801, the image forming apparatus 1 determines whether or not the OP key 2 is pressed. If the OP key 2 is pressed, then the image forming apparatus 1 proceeds to Act A802. Otherwise, the image forming apparatus 1 returns to Act A801.

In Act A802, the image forming apparatus 1 determines whether or not the EXIT sensor 142B is turned ON. If the EXIT sensor 142B is turned ON, then the image forming apparatus 1 proceeds to Act A803. Otherwise, the image forming apparatus 1 proceeds to Act A905 of FIG. 9.

In Act A803, the image forming apparatus 1 determines whether or not the PE sensor 141B is turned ON. If the PE sensor 141B is turned ON, then the image forming apparatus 1 proceeds to Act A804. Otherwise, the image forming apparatus 1 proceeds to Act A901 of FIG. 9.

In Act A901, the image forming apparatus 1 rotates the second cam motor 123A.

In Act A902, the image forming apparatus 1 rotates the second cam 101A to position III.

The image forming apparatus 1 rotates the feed motor 704 in Act A903 and discharges the recording medium 3 in Act A904.

If the PE sensor 141B is turned ON and the EXIT sensor 142B is turned OFF, that is, if the recording medium 3 exists only near the second printing device 100A on the recording medium conveyance path, then the image forming apparatus 1 separates the head 131 of the first printing device 100 from the platen 132 while separating the head 131A of the second printing device 100A from the platen 132A.

An operator may recover the recording medium 3 manually, as will be described in detail below.

In Act A801, the image forming apparatus 1 determines whether or not the OP key 2 is pressed. If the OP key 2 is pressed, then the image forming apparatus 1 proceeds to Act A802. Otherwise, the image forming apparatus 1 returns to Act A801.

In Act A802, the image forming apparatus 1 determines whether or not the EXIT sensor 142B is turned ON. If the EXIT sensor 142B is turned ON, then the image forming apparatus 1 proceeds to Act A803. Otherwise, the image forming apparatus 1 proceeds to Act A905 of FIG. 9.

In Act A905, the image forming apparatus 1 determines whether or not the PE sensor 141B is turned ON. If the PE sensor 141B is turned ON, then the image forming apparatus 1 proceeds to Act A906. Otherwise, the image forming apparatus 1 displays an error in Act A910.

In Act A906, the image forming apparatus 1 rotates the first cam motor 123.

In Act A907, the image forming apparatus 1 rotates the first cam 101 to position III.

In Act A908, the image forming apparatus 1 rotates the second cam motor 123A.

In Act A909, the image forming apparatus 1 rotates the second cam 101A to position III.

Figure 10:
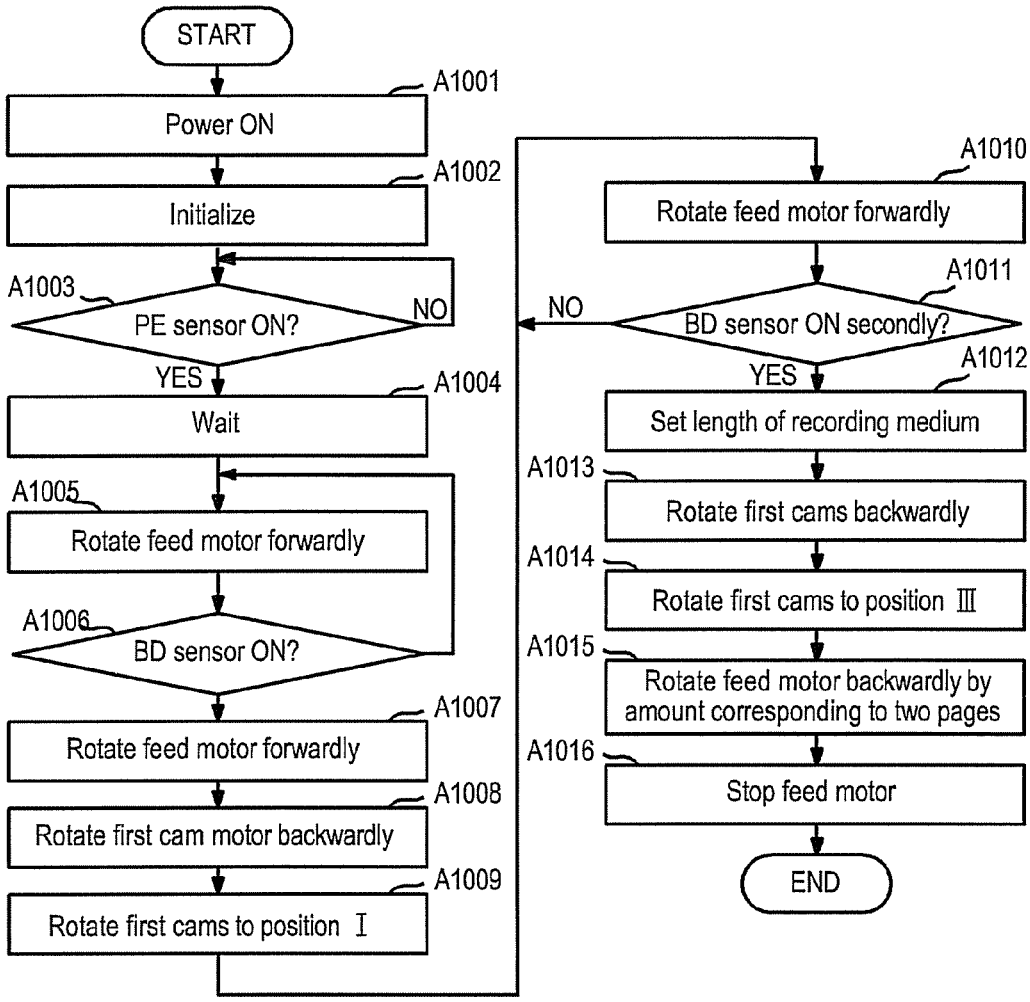
FIG. 10 is a flow chart showing an auto-loading operation of a recording medium by a black mark.

FIG. 10 is a flow chart showing an auto-loading operation of the recording medium by a black mark.

The image forming apparatus 1 separates the head 131 of the first printing device 100 from the platen 132, loads the recording medium 3 forwardly while weakly pressurizing the head 131A of the second printing apparatus 100A to the platen 132A, detects a length of the recording medium 3 while strongly pressurizing the head 131 of the first printing apparatus 100 to the platen 132, separates the head 131 of the first printing device 100 from the platen 132, and adjusts a head page to a printable position by moving the recording medium 3 backwardly while weakly pressurizing the head 131A of the second printing apparatus 100A to the platen 132A, which will be described in more detail below.

As shown in FIG. 10, in Act A1001, the image forming apparatus 1 is powered ON.

In Act A1002, the image forming apparatus 1 performs an initialization operation. Specifically, the image forming apparatus 1 drives the first cam motor 123 to rotate the first cams 101 to position III and drives the second cam motor 123A to rotate the second cam 101A to position II.

In Act A1003, the image forming apparatus 1 determines whether or not the PE sensor 141B is turned ON. If the PE sensor 141B is turned ON, then the image forming apparatus 1 proceeds to Act A1004. Otherwise, the image forming apparatus 1 returns to Act A1003.

In Act A1004, the image forming apparatus 1 waits for a predetermined period of time, for example, 0.5 sec.

In Act A1005, the image forming apparatus 1 rotates the feed motor 704 to convey the recording medium 3.

In Act A1006, the image forming apparatus 1 determines whether or not the BD sensor is turned ON. If the BD sensor is turned ON, then the image forming apparatus 1 proceeds to Act A1007. Otherwise, the image forming apparatus 1 returns to Act A1005.

In Act A1007, the image forming apparatus 1 further rotates the feed motor 704 by a predetermined number of steps.

In Act A1008, the image forming apparatus 1 rotates the first cam motor 123 reversely.

In Act A1009, the image forming apparatus 1 rotates the first cams 101 to position I.

In Act A1010, the image forming apparatus 1 rotates the feed motor 704. The image forming apparatus 1 counts the number of rotation steps of the feed motor 704.

In Act A1011, the image forming apparatus 1 determines whether or not the BD sensor is turned ON secondly. If the BD sensor is turned ON secondly, then the image forming apparatus 1 proceeds to Act A1012. Otherwise, the image forming apparatus 1 returns to Act A1010.

In Act A1012, the image forming apparatus 1 sets the counted number of steps to a length of the recording medium.

In Act A1013, the image forming apparatus 1 rotates the first cam motor 123 reversely.

In Act A1014, the image forming apparatus 1 rotates the first cams 101 to position III.

In Act A1015, the image forming apparatus 1 rotates the feed motor 704 reversely by an amount corresponding to two pages of the set length of the recording medium. This operation allows the head of the recording medium 3 to be conveyed to a printable position.

In Act A1016, the image forming apparatus 1 stops the feed motor 704.

Figure 11:
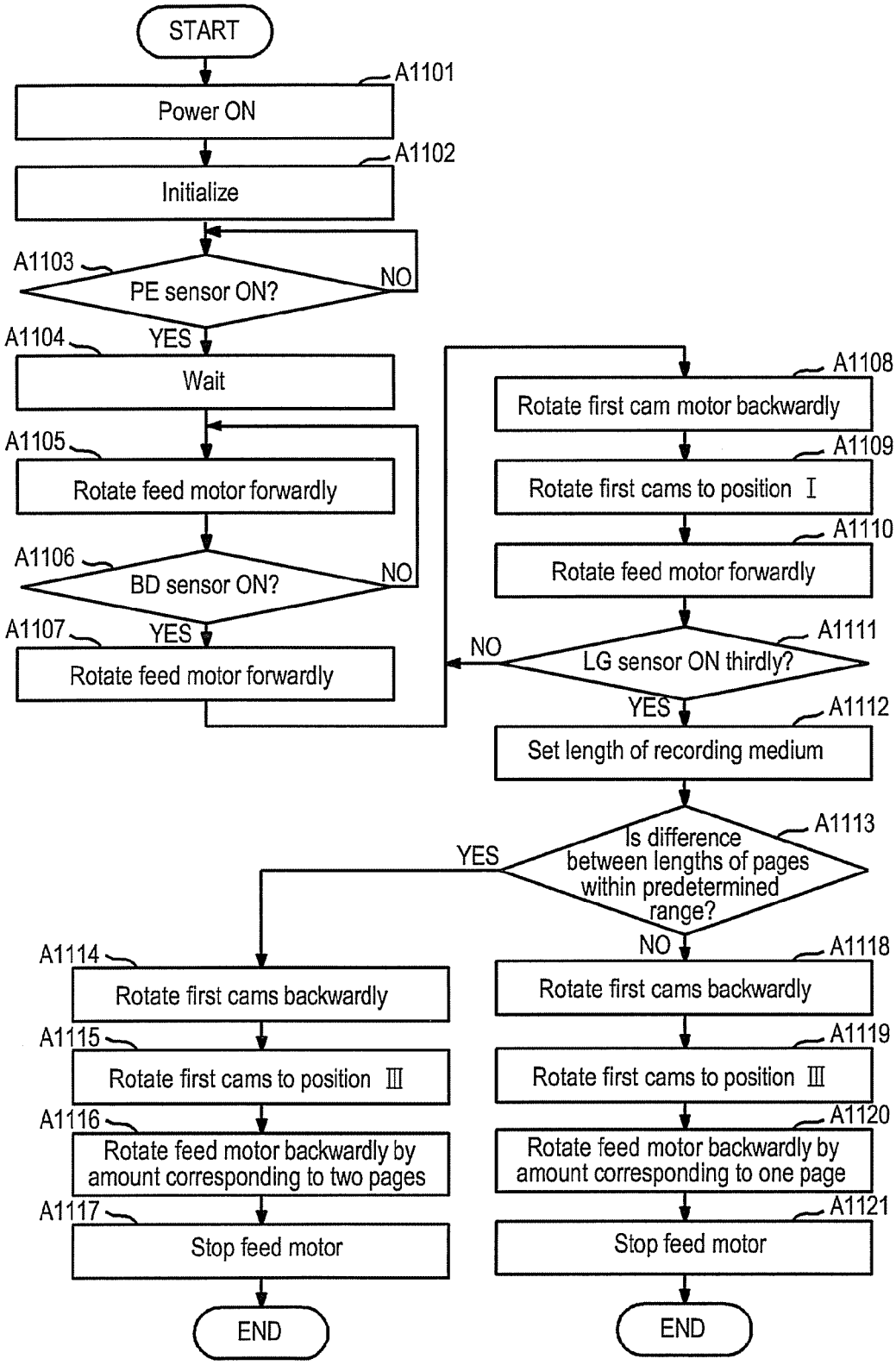
FIG. 11 is a flow chart showing an auto-loading operation of a recording medium by a label gap.

FIG. 11 is a flow chart showing an auto-loading operation of the recording medium by a label gap.

If a label is attached to the recording medium 3, then the image forming apparatus 1 may detect a difference between intensities of transmission light by means of the LG sensor and thus a position of the label based on the difference.

The image forming apparatus 1 separates the head 131 of the first printing device 100 from the platen 132, loads the recording medium 3 while weakly pressurizing the head 131A of the second printing apparatus 100A to the platen 132A, detects a length of the recording medium 3 while strongly pressurizing the head 131 of the first printing apparatus 100 to the platen 132, separates the head 131 of the first printing device 100 from the platen 132, and adjusts a head page to a printable position by moving the recording medium 3 backwardly while weakly pressurizing the head 131A of the second printing apparatus 100A to the platen 132A, which will be described in more detail below.

As shown in FIG. 11, in Act A1101, the image forming apparatus 1 is powered ON.

In Act A1102, the image forming apparatus 1 performs an initialization operation. Specifically, the image forming apparatus 1 drives the first cam motor 123 to rotate the first cams 101 to position III and drives the second cam motor 123A to rotate the second cam 101A to position II.

In Act A1103, the image forming apparatus 1 determines whether or not the PE sensor 141B is turned ON. If the PE sensor 141B is turned ON, then the image forming apparatus 1 proceeds to Act A1104. Otherwise, the image forming apparatus 1 returns to Act A1103.

In Act A1104, the image forming apparatus 1 waits for a predetermined period of time, for example, 0.5 sec.

In Act A1105, the image forming apparatus 1 rotates the feed motor 704 to convey the recording medium 3.

In Act A1106, the image forming apparatus 1 determines whether or not the BD sensor is turned ON. If the BD sensor is turned ON, then the image forming apparatus 1 proceeds to Act A1107. Otherwise, the image forming apparatus 1 returns to Act A1105.

In Act A1107, the image forming apparatus 1 further rotates the feed motor 704 by a predetermined number of steps.

In Act A1108, the image forming apparatus 1 rotates the first cam motor 123 reversely.

In Act A1109, the image forming apparatus 1 rotates the first cams 101 to position I.

In Act A1110, the image forming apparatus 1 rotates the feed motor 704. Here, the image forming apparatus 1 counts the number of rotation steps of the feed motor 704.

In Act A1111, the image forming apparatus 1 determines whether or not the LG sensor is turned ON thirdly. If the LG sensor is turned ON thirdly, then the image forming apparatus 1 proceeds to Act A1112. Otherwise, the image forming apparatus 1 returns to Act A1108.

In Act A1112, the image forming apparatus 1 sets the counted number of steps to a length of the recording medium for each of first and second pages.

In Act A1113, the image forming apparatus 1 determines whether or not a difference between the length of the first page and the length of the second page is within a predetermined range, for example, 2 mm. If the difference between the length of the first page and the length of the second page is within the predetermined range, then the image forming apparatus 1 proceeds to Act A1114. Otherwise, the image forming apparatus 1 proceeds to Act A1118.

In Act A1114, the image forming apparatus 1 rotates the first cam motor 123 reversely.

In Act A1115, the image forming apparatus 1 rotates the first cams 101 to position III.

In Act A1116, the image forming apparatus 1 rotates the feed motor 704 reversely by an amount corresponding to two pages of the set length of the recording medium. This Act allows the head of the recording medium 3 to be conveyed to a printable position.

In Act A1117, the image forming apparatus 1 stops the feed motor 704.

In Act A1118, the image forming apparatus 1 rotates the first cam motor 123 reversely.

In Act A1119, the image forming apparatus 1 rotates the first cams 101 to position III.

In Act A1120, the image forming apparatus 1 rotates the feed motor 704 reversely by an amount corresponding to one page of the set length of the recording medium. This operation allows the head of the second page of the recording medium 3 to be conveyed to a printable position.

In Act A1121, the image forming apparatus 1 stops the feed motor 704.

As described above, the image forming apparatus 1 according to this embodiment includes: the first printing device 100 for printing the front surface of the recording medium 3, including the head 131, the platen 132 opposed to the head 131 with the recording medium conveyance path P interposed therebetween, and the head pressurizing force adjusting mechanism 100B for adjusting the pressurizing force of the head 131 to the platen 132; the second printing device 100A disposed in the upstream in the recording medium conveyance direction of the first printing device 100 and prints the back surface of the recording medium 3, including the head 131A, the platen 132A opposed to the head 131A with the recording medium conveyance path P interposed therebetween, and the head pressurizing force adjusting mechanism 100B for adjusting the pressurizing force of the head 131A to the platen 132A; and the control unit that controls the pressurizing force of the head 131 to the platen 132 in the first printing device 100 and the pressurizing force of the head 131A to the platen 132A in the second printing device 100A while selecting one of the forward conveyance and the backward conveyance of the recording medium 3 depending on a position of the recording medium 3 on the recording medium conveyance path P when the recording medium is discharged.

Further, in case that the recording medium 3 is loaded, the control unit controls the pressurizing force of the head 131 to the platen 132 in the first printing device 100 or the pressurizing force of the head 131A to the platen 132A in the second printing device 100A, depending on whether the recording medium 3 is moved forward to detect its page length, or the recording medium 3 is moved backward to adjust its head page to a printable position.

Thus, the image forming apparatus has an advantage in that the recording medium 3 can be easily discharged irrespective of conditions of the recording medium 3 on the recording medium conveyance path P and printing from the head of the recording medium is possible without wastefulness of the recording medium 3.

As used in this application, entities for executing the actions can refer to a computer-related entity, either hardware, a combination of hardware and software, software, or software in execution. For example, an entity for executing an action can be, but is not limited to being, a process running on a processor, a processor, an object, an executable, a thread of execution, a program, and a computer. By way of illustration, both an application running on an apparatus and the apparatus can be an entity. One or more entities can reside within a process and/or thread of execution and an entity can be localized on one apparatus and/or distributed between two or more apparatuses.

The program for realizing the functions can be recorded in the apparatus, can be downloaded through a network to the apparatus, or can be installed in the apparatus from a computer readable storage medium storing the program therein. A form of the computer readable storage medium can be any form as long as the computer readable storage medium can store programs and is readable by the apparatus such as a disk type ROM and a solid-state computer storage media. The functions obtained by installation or download in advance in this way can be realized in cooperation with an OS (Operating System) in the apparatus.

While certain embodiments have been described, these embodiments have been presented by way of example only, and are not intended to limit the scope of the inventions. Indeed, the novel methods and apparatuses described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A head pressurizing force adjusting device, comprising:

a plurality of cams having different radiuses;

an arm configured to contact with the cams and be rotated with rotation of the cams;

a head which is opposed to a platen with a recording medium conveyance path interposed between the head and the platen;

a head support member configured to bring the head into contact with the platen when the arm is rotated by a radius having a first length of the cams, brings the head into contact with the platen with a contact pressure weaker than a contact pressure when the arm is rotated by the radius having the first length, with the head support member being separated from the arm as the arm is displaced in the opposite direction to the platen when the arm is rotated by a radius having a second length of the cams, and brings the head into contact with the platen with a contact pressure weaker than a contact pressure when the arm is rotated by the radius having the second length, with the arm being displaced in such a manner that the head is separated from the platen when the arm is rotated by a radius having a third length of the cams;

a first elastic member configured to bias the arm toward the head support member; and a second elastic member configured to bias the head support member toward the platen.

2. The device of claim 1, further comprising:

a sensor configured to detect a position of a recording medium;

a driving unit configured to rotate the cams; and a control unit configured to drive the driving unit based on an output of the sensor.

3. The device of claim 2, wherein the control unit rotates the cams to separate the head from the platen when the recording medium is removed.

4. An image forming apparatus, comprising:

a first sensor which is disposed in the downstream of a recording medium conveyance path and detects a recording medium;

a second sensor which is disposed in the upstream of the recording medium conveyance path and detects the recording medium;

a first head which is interposed between the first sensor and the second sensor in the opposite to a first platen with the recording medium conveyance path interposed between the first head and the first platen and forms an image on a first surface of the recording medium;

a first head pressurizing force adjusting device configured to adjust a pressurizing force of the first head to the first platen;

a second head which is interposed between the first head and the second sensor in the opposite to a second platen with the recording medium conveyance path interposed between the second head and the second platen and forms an image on a second surface of the recording medium;

a second head pressurizing force adjusting device configured to adjust a pressurizing force of the second head to the second platen; and a control unit configured to control the first head pressurizing force adjusting device and the second head pressurizing force adjusting device based on outputs of the first and second sensors.

5. The apparatus of claim 4, wherein, if the first and second sensors detect the recording medium together when the recording medium is discharged, the control unit controls the first head to be separated from the first platen and the recording medium to be discharged with backward movement.

6. The apparatus of claim 4, wherein, if the first sensor detects the recording medium but the second sensor does not detect the recording medium when the recording medium is discharged, the control unit controls the second head to be separated from the second platen and the recording medium to be discharged with forward movement.

7. The apparatus of claim 4, wherein, if the first sensor does not detect the recording medium but the second sensor detects the recording medium when the recording medium is discharged, the control unit controls the first head to be separated from the first platen and the second head to be separated from the second platen.

8. The apparatus of claim 4, further comprising: a third sensor which is interposed between the first head and the second head and detects a black mark of the recording medium, wherein, when the recording medium is loaded, the control unit controls the recording medium to be moved forward with the first head pressed to the first platen, detects a page length of the recording medium based on an output of the third sensor, separates the first head from the first platen, and controls the recording medium to be moved backward to adjust a head page of the recording medium to a printable position.

9. The apparatus of claim 4, further comprising: a fourth sensor which is interposed between the first head and the second head and detects a label based on intensity of transmission light of the recording medium, wherein, when the recording medium is loaded, the control unit controls the recording medium to be moved forward with the first head pressed to the first platen, detects a leading end position of the label based on an output of the fourth sensor, separates the first head from the first platen, and controls the recording medium to be move backward to adjust a head label of the recording medium to a printable position.

10. The apparatus of claim 4, wherein the first head pressurizing force adjusting device includes:

a plurality of first cams having different radiuses;

a first arm configured to contact with the first cams and is rotated with rotation of the first cams;

a first head which is opposed to a first platen with a recording medium conveyance path interposed between the first head and the first platen;

a first head support member configured to bring the first head into contact with the first platen when the first arm is rotated by a radius having a first length of the first cams, bring the first head into contact with the first platen with a contact pressure weaker than a contact pressure when the first arm is rotated by the radius having the first length, with the first head support member being separated from the first arm as the first arm is displaced in the opposite direction to the first platen when the first arm is rotated by a radius having a second length of the first cams, and bring the first head into contact with the first platen with a contact pressure weaker than a contact pressure when the first arm is rotated by the radius having the second length, with the first arm being displaced in such a manner that the first head is separated from the first platen when the first arm is rotated by a radius having a third length of the first cams;

a first one of first elastic members configured to bias the first arm toward the first head support member; and a second one of the first elastic members configured to bias the first head support member toward the first platen, wherein the second head pressurizing force adjusting device includes:

a plurality of second cams having different radiuses;

a second arm configured to contact with the second cams and is rotated with rotation of the second cams;

a second head which is opposed to a second platen with a recording medium conveyance path interposed between the second head and the second platen;

a second head support member configured to bring the first head into contact with the second platen when the second arm is rotated by a radius having a first length of the second cams, bring the second head into contact with the second platen with a contact pressure weaker than a contact pressure when the second arm is rotated by the radius having the first length, with the second head support member being separated from the second arm as the second arm is displaced in the opposite direction to the second platen when the second arm is rotated by a radius having a second length of the second cams, and bring the second head into contact with the second platen with a contact pressure weaker than a contact pressure when the second arm is rotated by the radius having the second length, with the second arm being displaced in such a manner that the second head is separated from the second platen when the second arm is rotated by a radius having a third length of the second cams;

a first one of second elastic members configured to bias the second arm toward the second head support member; and a second one of the second elastic members configured to bias the second head support member toward the second platen.

11. A method of adjusting a head pressurizing force, the method, comprising:

changing a pressurizing force of a plurality of heads, which is disposed along a recording medium conveyance path, to a plurality of platens by changing the number of elastic members biasing the heads toward the platens based on an output of a sensor detecting a position of a recording medium;

inputting outputs of a first sensor which is disposed in the downstream of a recording medium conveyance path and detects a recording medium and a second sensor which is disposed in the upstream of the recording medium conveyance path and detects the recording medium;

separating a first head from a first platen if the first and second sensors detect the recording medium together; and discharging the recording medium with backward movement.

12. The method of claim 11, further comprising:

separating a second head from a second platen if the first sensor detects the recording medium but the second sensor does not detect the recording medium when the recording medium is discharged; and discharging the recording medium with forward movement.

13. The method of claim 11, further comprising:

separating the first head from the first platen and a second head from a second platen if the first sensor does not detect the recording medium but the second sensor detects the recording medium when the recording medium is discharged.

14. The method of claim 11, further comprising:

moving forward the recording medium with the first head pressed to the first platen;

detecting a page length of the recording medium based on an output of a third sensor which detects a black mark of the recording medium;

separating the first head from the first platen; and moving backward the recording medium to adjust a head page of the recording medium to a printable position.

15. The method of claim 11, further comprising:

moving forward the recording medium with the first head pressed to the first platen;

detecting a leading end position of a label of the recording medium based on an output of a fourth sensor which detects the label based on intensity of transmission light of the recording medium;

separating the first head from the first platen; and moving backward the recording medium to adjust a head label of the recording medium to a printable position.

* * * * *